US007438769B2

(12) United States Patent
Ko et al.

(10) Patent No.: US 7,438,769 B2
(45) **Date of Patent: *Oct. 21, 2008**

(54) PROCESS FOR DIFFUSING TITANIUM AND NITRIDE INTO A MATERIAL HAVING A COATING THEREON

(76) Inventors: Philos Jongho Ko, 372 Sleepy Hollow La., Addison, IL (US) 60101; Bongsub Samuel Ko, 372 Sleepy Hollow La., Addison, IL (US) 60101

( * ) Notice: Subject to any disclaimer, the term of this patent is extended or adjusted under 35 U.S.C. 154(b) by 0 days.

This patent is subject to a terminal disclaimer.

(21) Appl. No.: 11/405,959

(22) Filed: Apr. 18, 2006

(65) Prior Publication Data

US 2007/0243398 A1 Oct. 18, 2007

(51) Int. Cl.

| | |
|---|---|
| ***B05D 1/18*** | (2006.01) |
| ***B05D 3/02*** | (2006.01) |
| ***B05D 3/10*** | (2006.01) |
| ***C23C 26/00*** | (2006.01) |
| ***C23C 30/00*** | (2006.01) |

(52) U.S. Cl. ..... 148/206; 148/212; 148/228; 148/231; 148/238; 148/317; 427/376.6; 427/383.3; 427/436

(58) Field of Classification Search ..... 148/212, 148/228, 230, 231, 232, 238, 281, 669, 317, 148/421, 206, 210; 427/435, 436, 430.1, 427/376.1, 376.3, 376.4, 376.6, 376.7, 376.8, 427/383.1, 383.3, 383.7, 419.1, 419.7

See application file for complete search history.

(56) References Cited

U.S. PATENT DOCUMENTS

| | | | | |
|---|---|---|---|---|
| 3,639,641 | A | 2/1972 | Saton | |
| 4,019,928 | A | 4/1977 | Beyer et al. | |
| 4,332,653 | A | 6/1982 | Satoh | |
| 4,492,604 | A | 1/1985 | Muller et al. | |
| 6,645,566 | B2 | 11/2003 | Ko | |
| 6,881,498 | B1 * | 4/2005 | Cooper et al. | 428/615 |

* cited by examiner

*Primary Examiner*—Michael La Villa
(74) *Attorney, Agent, or Firm*—Eugene M. Cummings

(57) ABSTRACT

A method for diffusing titanium and nitride into a base material having a coating thereon using conventional surface treatments or coatings. The method generally includes the steps of providing a base material having a coating thereon; providing a salt bath which includes sodium dioxide and a salt selected from the group consisting of sodium cyanate and potassium cyanate; dispersing metallic titanium formed by electrolysis of a titanium compound in the bath; heating the salt bath to a temperature ranging from about 430° C. to about 670° C.; and soaking the base material in the salt bath for a time of from about 10 minutes to about 24 hours. In accordance with another aspect of the present invention, titanium and nitride may be diffused into a base material without a coating. The treated base material may further be treated with conventional surface treatments or coatings.

19 Claims, 3 Drawing Sheets

PROCESS FOR DIFFUSING TITANIUM AND NITRIDE INTO A MATERIAL HAVING A COATING THEREON

BACKGROUND OF THE INVENTION

The present invention generally relates to a process for diffusing titanium and nitride into a material. More specifically, a process is provided for diffusing titanium and nitride into a material having a coating thereon.

The present invention relates to a low temperature process for diffusing titanium and nitride into a base material having a coating thereon in the presence of electrolyzed titanium. A low temperature process is preferred in that it prevents or lessens warping and twisting of the material. Titanium is considered a generally inert, light-weight material which has very high tensile strength (or toughness) and excellent corrosion resistance. Accordingly, because of their inert nature, increased hardness, increased tensile strength and increased resistance to wear, products containing titanium may be used in various applications including industrial, biomedical, aerospace, automotive, defense, jewelry, tools, tool-making, gun-making applications and other such applications.

U.S. Pat. No. 6,645,566, which is incorporated by reference herein and made a part hereof, describes a process for diffusing titanium and nitride into a variety of base materials including steel and steel alloys, aluminum and aluminum alloys, titanium and titanium alloys. Nevertheless, U.S. Pat. No. 6,645,566 does not describe a method for diffusing titanium and nitride into a material having a coating thereon.

Various materials (e.g., carbide, metal and metal alloys) are used in applications which require hardness, tensile strength and/or resistance to wear. Although these materials may inherently include these attributes, it is desirable to further enhance such. Accordingly, various surface treatment and coating processes have been applied to these materials. Conventional surface treatment and coating processes may include, but are not limited to, heat treatment, nanocoating, ceramic coating, Physical Vapor Deposition (PVD), Chemical Vapor Deposition (CVD), Ion Assisted Coating (IAC), and other suitable surface treatments or coating. These conventional processes are typically preferred because they extend the life of the material at a lower cost than replacement of such.

Nevertheless, a coating is only as good as the strength of the bond between the coating and the substrate material. Good adhesion is an important prerequisite in engineering a commercially useful coating process. For this reason, a number of coating processes have been developed, each attempting to improve the interfacial strength between the coating and the base material.

In one example, conventional surface treatments and coating processes have been typically applied to steel and steel alloys. Steel and steel alloys are generally known to contain a high content of iron. Some conventional surface treatment processes, such as in some Physical Vapor Deposition (PVD), Chemical Vapor Deposition (CVD) and Ion Assisted Coating (IAC) processes, involve nitriding, wherein nitrogen is introduced such that it reacts to iron in the steel or steel alloy to form a hardened ferrous nitride layer. This reaction causes the formation of a hardened ferrous nitride layer, which serves as a suitable coating on the base material.

These nitriding processes, however, are generally deficient when treating materials which contain a relatively low content of iron (e.g., carbide). As such, when applying these processes to such materials, there is generally not enough iron for nitrogen to react with. Accordingly, conventional nitriding surface treatments cannot generally form a hardened ferrous nitride layer on the base material due to its low iron content. Instead, a coating is formed which has a weak adhesion with the base material surface, thereby causing it to be susceptible to chipping.

It is therefore an object of the present invention to diffuse titanium and nitride into a material having a coating thereon, in order to enhance the coating in and of itself. It is also an object of the invention to provide a process which allows for the implementation of the enhanced properties of titanium in both the coating and the base material.

SUMMARY OF THE INVENTION

In view of the desired goals of the invention claimed herein, a method for diffusing titanium and nitride into a base material having a coating thereon and products produced thereby are provided. As such, the present invention process allows for the implementation of the enhanced properties of titanium in both the coating and the base material.

In one such embodiment, the base material may be treated using the present invention titanium and nitride diffusion process and then treated with a conventional surface treatment or coating. The method generally includes the steps of providing a base material having a coating thereon; providing a salt bath which includes sodium dioxide and a salt selected from the group consisting of sodium cyanate and potassium cyanate; dispersing metallic titanium formed by electrolysis of a titanium compound, in said bath; heating the salt bath to a temperature ranging from about 430° C. to about 670° C.; and soaking the coated material in the salt bath for a time of from about 10 minutes to about 24 hours.

In accordance with this embodiment, titanium and nitrogen diffuses and fills the voids within the coating structure, while also diffusing and filling in the voids within base material structure. Moreover, the diffusion from the coating en route to the underlying base material forms a resulting titanium interface or network therebetween. This interface or network provides for the added benefit of providing better adhesion between the coating and the underlying base material.

In accordance with an aspect of the invention, a treated article is provided including a base material having a coating thereon, wherein the base material and coating each include a microstructure; a titanium component diffused into each of the microstructures; and the titanium component is in addition to any titanium present in each of the coating and the base material.

In accordance with another aspect of the invention, a treated article is provided comprising a treated base material having a particular microstructure; a titanium component diffused into the microstructure; and the titanium component is in addition to any titanium present in the base material.

In yet another embodiment, the base material may be treated with a conventional surface treatment or coating after being treated using the present invention titanium and nitride diffusion process. The method generally includes the steps of providing a base material; providing a salt bath which includes sodium dioxide and a salt selected from the group consisting of sodium cyanate and potassium cyanate; dispersing metallic titanium formed by electrolysis of a titanium compound, in said bath; heating the salt bath to a temperature ranging from about 430° C. to about 670° C.; soaking the base material in the salt bath for a time of from about 10 minutes to about 24 hours; and treating the base material.

In accordance with the various aspects of the present invention, the coating of the base material may be formed using a process selected from the group consisting of heat treatment, nanocoating, ceramic coating, Physical Vapor Deposition (PVD), Chemical Vapor Deposition (CVD), and Ion Assisted Coating (IAC).

It should be understood that the present invention includes a number of different aspects or features which may have utility alone and/or in combination with other aspects or features. Accordingly, this summary is not exhaustive identification of each such aspect or feature that is now or may hereafter be claimed, but represents an overview of certain aspects of the present invention to assist in understanding the more detailed description that follows. The scope of the invention is not limited to the specific embodiments described below, but is set forth in the claims now or hereafter filed.

BRIEF DESCRIPTION OF THE SEVERAL VIEWS OF THE DRAWINGS

Throughout this description, reference has been and will be made to the accompanying views of the drawing wherein like subject matter has like reference numerals, and wherein.

DETAILED DESCRIPTION OF THE MULTIPLE EMBODIMENTS

Figure 1:
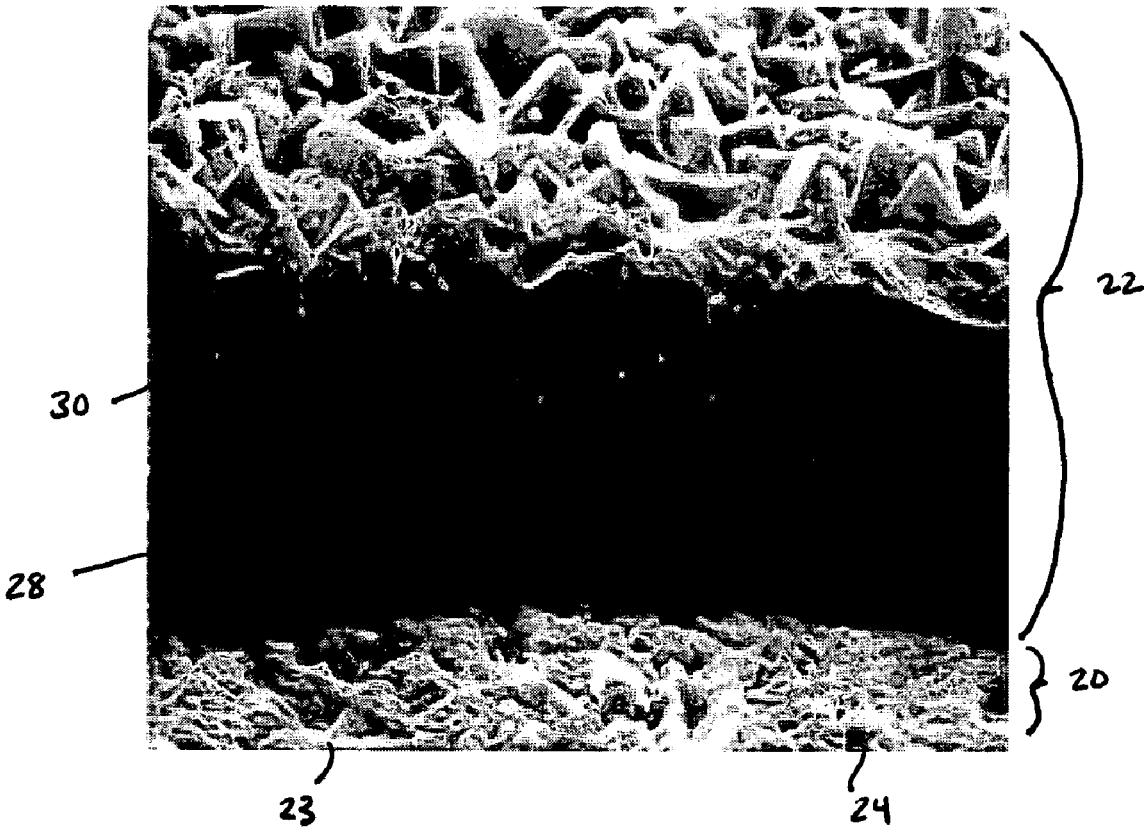
FIG. 1 is a scanning electron micrograph cross-sectional view of a representative carbide having a CVD coating thereon and prior to having titanium and nitride diffused therethrough in accordance with an aspect of the present invention.

While the invention is susceptible of embodiment in many different forms and in various combinations, particular focus will be on the multiple embodiments of the invention described herein with the understanding that such embodiments are to be considered exemplifications of the principles of the invention and are not intended to limit the broad aspect of the invention. For example, the present invention involves a base material including a coating thereon. The base material is defined herein as any material which requires hardness, tensile strength and/or resistance to wear. Suitable base materials may include, but are not limited to, metals, metal alloys and/or carbides. For example, suitable base materials may further include, but are not limited to, aluminum, aluminum alloys, steel, steel alloys, titanium and titanium alloys.

The present invention also involves surface treatments and coatings. For purposes of the present invention, surface treatments and coatings include any process which enhances the hardness, tensile strength and/or resistance to wear of a base material. Such processes include, but are not limited to, heat treatment, nanocoating, ceramic coating, Physical Vapor Deposition (PVD), Chemical Vapor Deposition (CVD), Ion Assisted Coating (IAC), and other suitable surface treatments or coatings.

In order to further enhance its hardness, tensile strength and resistance to wear, the base material may be treated with a conventional surface treatment or coating and then treated using the present invention titanium and nitride diffusion process. In yet another embodiment, the base material may be treated using the present invention titanium and nitride diffusion process and then treated with a conventional surface treatment or coating. As discussed above, any conventional process for treating or coating materials may be used in these embodiments.

In accordance with an embodiment of the present invention, a base material may be treated with a conventional surface treatment or coating and then treated using the present invention titanium and nitride diffusion process as follows. A base material is surface treated or coated using a suitable means. Otherwise, a base material having a coating thereon may be provided.

The base material having a coating thereon is soaked in a moderately heated non-electrolyzed salt bath which contains activated-electrolyzed metallic titanium. Sodium dioxide and a salt selected from the group consisting of sodium cyanate and potassium cyanate is present in the salt bath. Additionally, up to about 20 w/w % of $NaCO_2$ or sodium chloride may further be added. To the bath is added from about 2 to about 20 micrograms of electrolyzed metallic titanium. The base material having a coating thereon is soaked in the bath for from about 10 minutes to 24 hours at from about 430° C. to about 670° C. The electrolyzed titanium catalyzes the diffusion of the titanium and nitride from the bath into both the base material and the coating thereon.

In accordance with this embodiment of the present invention process, titanium and nitrogen diffuses and fills the voids of the coating, while also diffusing and filling in the voids of the base material. Accordingly, both the base material and the coating are enhanced with inherent properties of titanium. Moreover, the diffusion from the coating en route to the underlying base material forms a resulting titanium interface or network therebetween. This interface or network provides for the added benefit of providing better adhesion between the coating and the underlying base material.

In accordance with an aspect of the invention, a treated article is provided including a base material having a coating thereon, wherein the base material and coating each include a microstructure; a titanium component diffused into each of the microstructures; and the titanium component is in addition to any titanium present in each of the coating and the base material.

In accordance with another aspect of the invention, a treated article is provided comprising a treated base material having a particular microstructure; a titanium component diffused into the microstructure; and the titanium component is in addition to any titanium present in the base material.

U.S. Pat. No. 6,645,566 describes soaking the base material from about 2 hours to about 10 hours, and preferably about 2 hours to about 6 hours. This soaking time is generally sufficient for ample diffusion of titanium and nitride into the amorphous structure of steel, aluminum and titanium. However and surprisingly, it is found that diffusion into the coating may occur as soon as 10 minutes into the soaking process. Furthermore, it is preferable to increase the time in which the base material having a coating thereon is soaked in the bath in order to facilitate adequate diffusion of titanium and nitride into both the coating and the base material.

EXAMPLE 1

Figure 2:
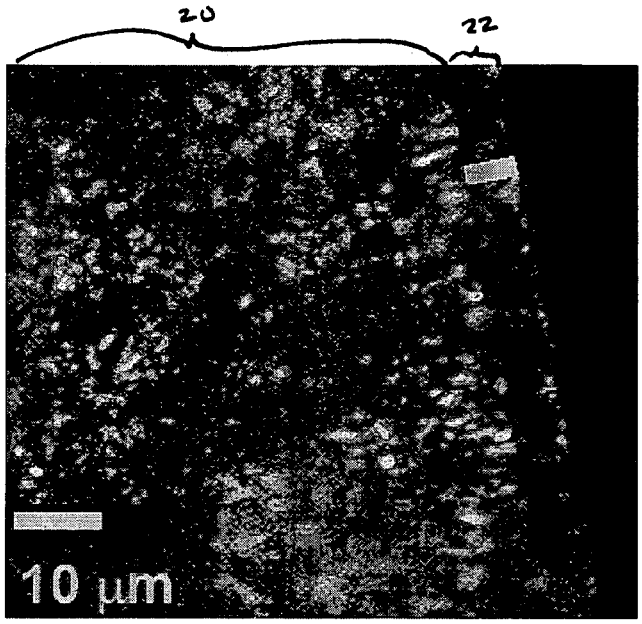
FIG. 2 is a cross-sectional view of a carbide treated with a CVD process and prior to having titanium and nitride diffused therethrough in accordance with an aspect of the present invention.

FIGS. 1 and 2 illustrate base material 20 containing carbide having a CVD coating 22 thereon. As shown in these figures, the base material 20 includes a generally compact, granular microstructure. Although the granular microstructure contributes to the hardness of the carbide, among the grains 23 are small voids 24 which perpetuate the brittleness of the carbide structure. In order to compensate for this brittleness, a coating may be formed thereon.

A CVD coating 22 is shown to be applied to the base material 20 using any conventional CVD process. More specifically, the base material may be exposed to one or more volatile precursors, which react and/or decompose on the base material to produce the desired coating 22. For example, titanium carbo-nitride+alumina may be used ($TiCN+Al_2O_3$). Alternatively, titanium nitride+alumina+titanium carbo-nitride ($TiN+Al_2O_3+TiN$) may be used. Structurally, the coating 22 is shown to have a crystalline microstructure, wherein among the crystals 28 are small voids 30. Like the voids 24 of the base material 20, the voids 30 among the crystals 28 contribute to the brittleness of the coating 22.

Moreover, there is a distinct interface and demarcation between the coating 22 and the surface of the base material 20, thereby illustrating a relatively weak adhesion therebetween which causes it to be susceptible to chipping. This demarcation further shows that the CVD process does not strengthen or increase the tensile properties of the base material 20 itself.

In order to further enhance the hardness, tensile strength and resistance to wear of both the coating 22 and the base material 20, titanium and nitride may be diffused into and fill the voids 24, 30 within both the base material 20 and the coating 22 as follows. This base material 20 having a coating 22 thereon was treated by soaking in a heated salt bath (NaCNO and about 10 w/w % of $NaCO_2$), for 2 hours at 545° C. in which 2-20 micrograms of electrolyzed metallic titanium was added. The base material 20 having a coating 22 thereon was then cooled and dried. The base material 20 having a coating 22 thereon was then washed to remove an oxidation layer formed as a result of heat being applied thereto during and after the diffusion process.

Figure 3:
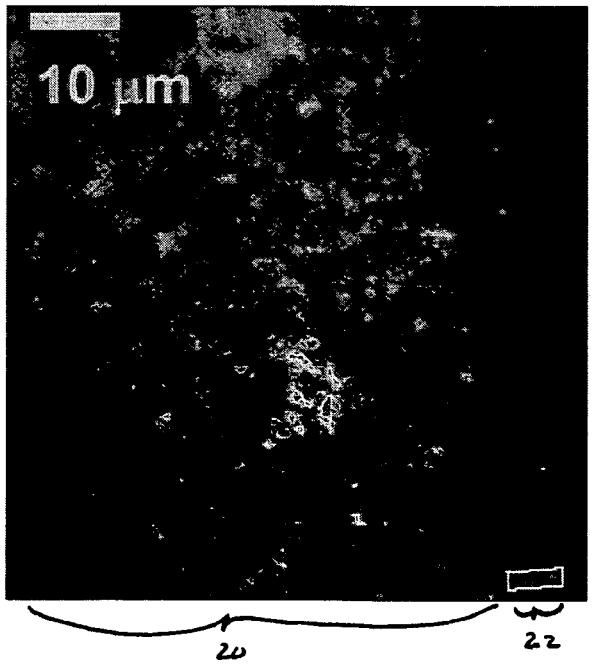
FIG. 3 is a cross-sectional view of a carbide treated with a CVD process and after having titanium and nitride diffused therethrough in accordance with an aspect of the present invention.

Through this process, titanium and nitride were diffused into both the coating 22 and the base material 20 as shown in FIG. 3. This diffusion was shown as the previously lighter material in FIG. 2 is now darker as shown in FIG. 3. The darkness appeared in both the coating 22 and the underlying carbide in the base material 20. Accordingly, titanium and nitrogen diffused and filled the voids of the coating 22, while also diffusing and filling in the voids among the grains of the carbide structure of the base material 20.

In this way, the diffusion from the coating 22 en route to the underlying carbide in the base material 20 formed a resulting titanium interface or network therebetween. This interface or network provided for the added benefit of providing better adhesion between the coating 22 and the underlying base material 20. Accordingly, in Example 1, it is illustrated that titanium and nitride surprisingly diffuses into not only the base material, but also the coating thereon, using the process of the present invention.

EXAMPLE 2

A metal alloy comprising carbide was used as a base material for a turning insert. The base material additionally included vanadium. The turning insert was further treated with a CVD process. This turning insert was treated by soaking in a heated salt bath (NaCNO and about 10 w/w % of $NaCO_2$), for 2 hours at 545° C. in which 2-20 micrograms of electrolyzed metallic titanium was added. The turning insert was then cooled and dried. The insert was then washed to remove an oxidation layer formed as a result of heat being applied thereto during and after the diffusion process.

The aforementioned turning insert treated with the present invention process was tested and compared to a turning insert treated only with a CVD process under the same operating parameters:

| | |
|---|---|
| Material Machined | Carbon Steel |
| Work Diameter | 19" |
| Spindle Speed (SFPM) | 330 |
| Feed Rate IPR | 0.04 |
| Depth of Cut | 0.25" per side |
| Length of Cut | 4'9" |
| No. of Passes | 8 |

After testing, the turning insert treated with the present invention process was surprisingly shown to have only slight wear. In contrast, the turning insert treated with only the CVD process showed significant chipping which resulted in catastrophic failure of the cutting tool.

EXAMPLE 3

A metal alloy comprising carbide was used as a base material for a turning insert. The base material additionally included vanadium. The turning insert was further treated with a CVD process. This turning insert was treated by soaking in a heated salt bath (NaCNO and about 10 w/w % of $NaCO_2$), for 2 hours at 545° C. in which 2-20 micrograms of electrolyzed metallic titanium was added. The turning insert was then cooled and dried. The insert was then washed to remove an oxidation layer formed as a result of heat being applied thereto during and after the diffusion process.

The aforementioned turning insert treated with the present invention process was tested and compared to a turning insert treated only with a CVD process under the same operating parameters:

| | |
|---|---|
| Material Machined | Carbon Steel |
| Work Diameter | 17" |
| Spindle Speed (SFPM) | 330 |
| Feed Rate IPR | 0.035 |
| Depth of Cut | 0.25" per side |
| Length of Cut | 5'9" |
| No. of Passes | 11 |

After testing, the turning insert treated with the present invention process was surprisingly shown to have only slight wear. In contrast, the turning insert treated with only the CVD process showed significant chipping which resulted in catastrophic failure of the cutting tool.

EXAMPLE 4

Figure 4:
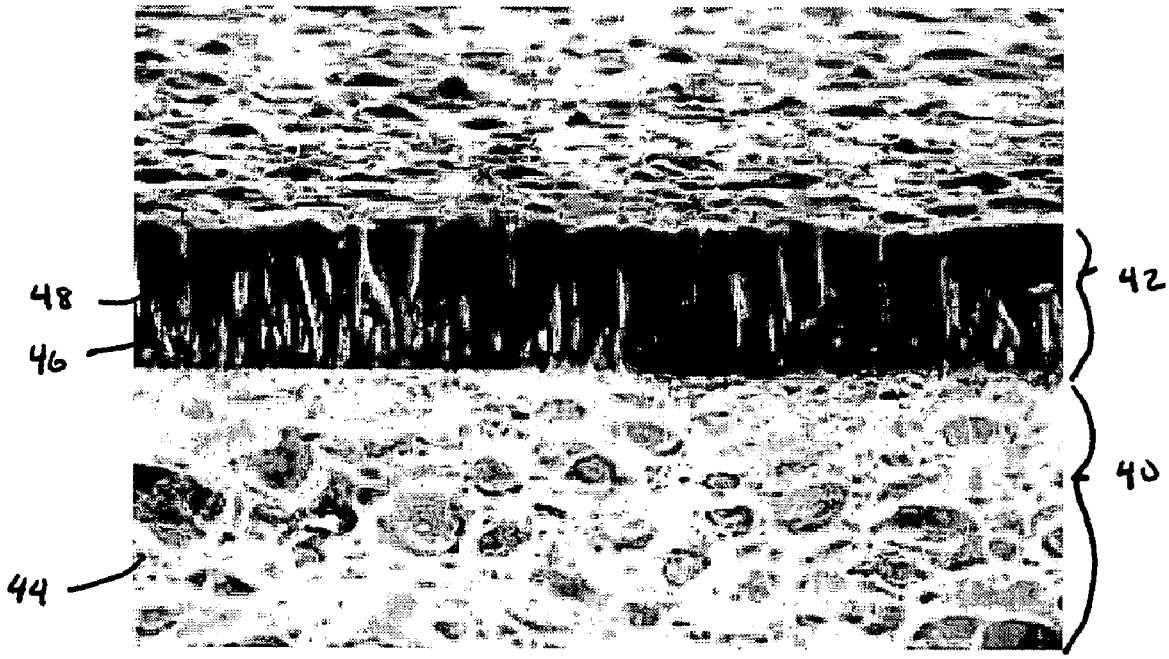
FIG. 4 is a scanning electron micrograph cross-sectional view of a representative steel having a PVD coating thereon and prior to having titanium and nitride diffused therethrough in accordance with an aspect of the present invention.

FIG. 4 is a representative illustration of a base material including steel 40 having a PVD coating 42 thereon. As shown in these figures, the base material 40 includes a generally amorphous microstructure. Within the amorphous microstructure are small voids 44 which decrease the hardness and tensile strength thereof. In order to compensate for such, a coating may be formed thereon.

A PVD coating 42 is shown to be applied to the base material 40 using any conventional PVD process. More specifically, a thin film (e.g., in this case coating 42) is applied to the base material 40. Although a titanium nitride (TiN) coating is illustrated herein, other suitable coatings may also be applied including, but not limited to titanium aluminum nitride (TiAlN), titanium carbo-nitride (TiCN) and chrome nitride (CrN) coatings. The coating 42 is shown to have a generally crystalline microstructure, wherein among the crystals 46 are small voids 48. Like the voids 44 of the base material 40, the voids 48 among the crystals 46 contribute to decreased hardness and tensile strength of the coating 42.

Moreover, there is a distinct interface and demarcation between the coating 42 and the surface of the base material 40, thereby illustrating a relatively weak adhesion therebetween which causes it to be susceptible to chipping. This demarcation further shows that the PVD process does not strengthen or increase the tensile properties of the base material 40 itself.

In order to further enhance the hardness, tensile strength and resistance to wear of both the coating 42 and the base material 40, titanium and nitride may be diffused into and fill the voids 48, 40 within both the base material 40 and the coating 42 as follows. In this example, this base material was used in an end mill. The end mill having the base material 40 and coating 42 thereon was treated by soaking in a heated salt bath (NaCNO and about 10 w/w % of $NaCO_2$), for 2 hours at 545° C. in which 2-20 micrograms of electrolyzed metallic titanium was added. This end mill was then cooled and dried. The end mill was then washed to remove an oxidation layer formed as a result of heat being applied thereto during and after the diffusion process.

Through this process, titanium and nitride were diffused into both the coating 42 and the base material 40 of the end mill. Moreover, the diffusion from the coating 42 en route to the underlying carbide in the base material 40 formed a resulting titanium interface or network therebetween. This interface or network provided for the added benefit of providing better adhesion between the coating 42 and the underlying base material 40.

The aforementioned end mill treated with the present invention process was tested and compared to an end mill treated only with a PVD process under the same operating parameters:

| | |
|---|---|
| Machined Material | Titanium |
| Machined Material Dimensions | 700 × 180 × 100 mm |
| Cutting Speed | 18 m/min, 225 RPM |
| Feed | 0.1 mm/tooth; 90 mm/min |
| Axial Depth | 25 mm |
| Radial Depth | 25 mm |
| Coolant | External Wear |
| No. of Passes | 7 (4.9 m) |

After testing, the end mill treated with the present invention process was shown to have flank wear. In contrast, the end mill treated with only the PVD process showed more significant flank wear.

It will be gleamed from the above examples and data that treatment of a base material having a coating thereon in accordance with the present invention surprisingly resulted in the diffusion of titanium and nitride into both the coating and the base material. The diffusion from the coating en route to the underlying base material further resulted in a titanium interface or network therebetween, thereby providing the added benefit of a better adhesion between the coating and the underlying base material. The excellent operating results were further obtained by the method of the present invention.

In accordance with yet another embodiment of the present invention, the base material may be treated using the present invention titanium and nitride diffusion process and then treated with a conventional surface treatment or coating as follows.

A base material is soaked in a moderately heated non-electrolyzed salt bath which contains activated-electrolyzed metallic titanium. Sodium dioxide and a salt selected from the group consisting of sodium cyanate and potassium cyanate is present in the salt bath. Additionally, up to about 20 w/w % of $NaCO_2$ or sodium chloride may further be added. To the bath is added from about 2 to about 20 micrograms of electrolyzed metallic titanium. The base material is soaked in the bath for from about 10 minutes to 24 hours at from about 430° C. to about 670° C. The electrolyzed titanium catalyzes the diffusion of the titanium and nitride from the bath into both the base material.

The base material which has been diffused with titanium and nitride may be further surface treated or coated using a suitable means such as heat treatment, nanocoating, ceramic coating, Physical Vapor Deposition (PVD), Chemical Vapor Deposition (CVD), Ion Assisted Coating (IAC), and other suitable surface treatments or coating.

EXAMPLE 5

In accordance with one aspect of the invention, a hexagonal broach comprising a base material containing steel was provided. The hexagonal broach was diffused with titanium and nitride and then further surface treated or coated as follows. The hexagonal broach was treated by soaking in a heated salt bath (NaCNO and about 10 w/w % of $NaCO_2$), for 2 hours at 545° C. in which 2-20 micrograms of electrolyzed metallic titanium was added. This hexagonal broach was then cooled and dried. The tool was then washed to remove an oxidation layer formed as a result of heat being applied thereto during and after the diffusion process. Through this process, titanium and nitride diffused into the base material of the tool.

The treated hexagonal broach was further treated using a conventional PVD process. More specifically, a thin film of TiN coating was applied to the surface of treated hexagonal broach. The aforementioned hexagonal broach treated with the present invention process was tested and compared to a hexagonal broach having a TiN coating applied using the same conventional PVD process under the same operating parameters. More specifically, the broaches were used to machine the same type of titanium part under the same operating parameters. It was observed that the broach treated in accordance with the present invention was able to machine 1950 parts. In contrast, the broach treated with only a conventional PVD process was only able to machine 1100 parts.

It will be gleamed from the above examples and data that treatment of a base material diffused with titanium and nitride and then treated with a conventional surface treatment or coating process achieved dramatically better operating results.

While this invention has been described with reference to certain illustrative aspects, it will be understood that this description shall not be construed in a limiting sense. Rather, various changes and modifications can be made to the illustrative embodiments without departing from the true spirit, central characteristics and scope of the invention, including those combinations of features that are individually disclosed or claimed herein. Furthermore, it will be appreciated that any such changes and modifications will be recognized by those skilled in the art as an equivalent to one or more elements of the following claims, and shall be covered by such claims to the fullest extent permitted by law.

The invention claimed is:

1. A method for diffusing titanium and nitride into a base material comprising:

providing a base material having a coating thereon, wherein said base material includes a microstructure including voids and said coating has a microstructure including voids contained therein;

providing a salt bath which includes sodium dioxide and a salt selected from the group consisting of sodium cyanate and potassium cyanate;

dispersing metallic titanium formed by electrolysis of a titanium compound, in said bath;

heating the salt bath to a temperature ranging from about 430° C. to about 670° C.; and soaking the coated material in the salt bath for at least about 10 minutes such that titanium and nitrogen diffuses into at least some of the voids of the microstructure of said coating and into at least some of the voids of the microstructure of said base material to form a titanium network therebetween.

2. The method of claim 1, wherein the step of soaking the coated material in the salt bath is for a time of about 10 minutes to about 24 hours.

3. The method of claim 1 wherein said salt bath is a non-electrolyzed salt bath.

4. The method of claim 1 wherein said salt bath includes up to about 20 w/w % of an added salt selected from the group consisting of sodium carbon dioxide, sodium carbonate, and sodium chloride.

5. The method of claim 1 wherein the soaking temperature ranges from about 500° C. to about 650° C.

6. The method of claim 3 wherein said salt bath includes up to about 20 w/w % of an added salt selected from the group consisting of sodium carbon dioxide, sodium carbonate, and sodium chloride.

7. The method of claim 1 wherein the coating is formed using a process selected from the group consisting of a nanocoating process, a ceramic coating process, a Physical Vapor Deposition (PVD) process, a Chemical Vapor Deposition (CVD) process, and an Ion Assisted Coating (IAC) process.

8. The method of claim 1 further comprising further treating the base material after soaking the material in the salt bath with a process selected from a group consisting of a heat treatment process, a nanocoating process, a ceramic coating process, a Physical Vapor Deposition (PVD) process, a Chemical Vapor Deposition (CVD) process, and an Ion Assisted Coating (IAC) process.

9. The method of claim 1 wherein the base material is a metal or metal alloy.

10. The method of claim 1 wherein the base material is selected from the group consisting of carbide, aluminum, aluminum alloy, steel, steel alloy, titanium and titanium alloy.

11. A method for diffusing titanium and nitride into a base material comprising:

applying a coating to a base material, wherein said base material includes a microstructure including voids and said coating has a microstructure including voids contained therein;

providing a salt bath which includes sodium dioxide and a salt selected from the group consisting of sodium cyanate and potassium cyanate;

dispersing metallic titanium formed by electrolysis of a titanium compound, in said bath;

heating the salt bath to a temperature ranging from about 430° C. to about 670° C.; and soaking the treated material in the salt bath for at least about 10 minutes such that titanium and nitrogen diffuses into at least some of the voids of the microstructure of said coating and into at least some of the voids of the microstructure of said base material to form a titanium network therebetween.

12. The method of claim 11, wherein the step of soaking the coated material in the salt bath is for a time of about 10 minutes to about 24 hours.

13. The method of claim 11 wherein said salt bath is a non-electrolyzed salt bath.

14. The method of claim 11 wherein said salt bath includes up to about 20 w/w % of an added salt selected from the group consisting of sodium carbon dioxide, sodium carbonate, and sodium chloride.

15. The method of claim 11 wherein the soaking temperature ranges from about 500° C. to about 650° C.

16. The method of claim 13 wherein said salt bath includes up to about 20 w/w % of an added salt selected from the group consisting of sodium carbon dioxide, sodium carbonate, and sodium chloride.

17. The method of claim 11 wherein the coating is formed using a process selected from the group consisting of a nanocoating process, a ceramic coating process, Physical Vapor Deposition (PVD) process, a Chemical Vapor Deposition (CVD) process, and an Ion Assisted Coating (IAC) process.

18. The method of claim 11 wherein the base material is a metal or metal alloy.

19. The method of claim 11 wherein the base material is selected from the group consisting of carbide, aluminum, aluminum alloy, steel, steel alloy, titanium and titanium alloy.

* * * * *